US005113853A

United States Patent [19]

Dickey

[11] Patent Number: 5,113,853

[45] Date of Patent: May 19, 1992

[54] HELMET WITH FILTERED AIR SUPPLY

[76] Inventor: Jonathan B. Dickey, 4360 NE. 11th Ave., #17, Oakland Park, Fla. 33334

[21] Appl. No.: 268,474

[22] Filed: Nov. 7, 1988

[51] Int. Cl.[5] ..... A62B 29/00

[52] U.S. Cl. ..... 128/200.28; 128/201.24

[58] Field of Search ..... 128/201.24, 201.25, 128/201.15, 863, 200.27, 200.28

[56] References Cited

U.S. PATENT DOCUMENTS 3,822,698 7/1974 Guy ..... 128/201.25
3,963,021 6/1976 Bancroft ..... 128/201.25
4,730,612 3/1988 Dampney ..... 128/201.24

*Primary Examiner*—Edgar S. Burr
*Assistant Examiner*—Aaron J. Lewis
*Attorney, Agent, or Firm*—Alvin S. Blum

[57] ABSTRACT

A protective helmet also provides filtered air for respiration. A thin flat fan and motor assembly with motor and blades coplanar mounts in an aperture in the crown. A hard cover covers both fan and aperture. A resilient cushion spaces the helmet and ducts the filtered air over the forehead and beneath the visor to the nose and mouth. The air flow rate is so great that the visor and helmet need not be sealed to the face to prevent inhalation of unfiltered air. The fan-motor structure reduces the center of gravity for comfortable use.

8 Claims, 2 Drawing Sheets

HELMET WITH FILTERED AIR SUPPLY

BACKGROUND OF THE INVENTION

This invention relates to helmets and more particularly to a visored helmet that protects the wearer from trauma and also provides a source of filtered air for respiration.

Hard hats are worn by users to protect the head from injury. The hats may also have transparent visors to further protect the face and eyes. Users are known to remove the hats when they become overheated and when the visors become fogged up, thereby endangering the user and possibly exposing an employer to liability.

Furthermore, many workers are exposed to harmful dusts and fumes. They may be provided with various types of filter masks or respirators to supply respiratory air from which such noxious materials have been removed. These may be awkward to use with a visored helmet and may require so much inspiratory effort to suck air through the filter that they may be put aside when they should be used. For workers with emphysema, any increase in inspiratory effort is overwhelming.

U.S. Pat. Nos. 3,881,478 issued May 6, 1975 to Rosendahl et al and 735,959 issued Aug. 11, 1903 to Folkmar disclose head coverings providing respiratory air from an external air supply through a duct. The duct restricts worker's movement and pulls on the head covering.

U.S. Pat. Nos. 3,963,021 issued Jun. 15, 1976 to Bancroft; 4,136,688 issued Jan. 30, 1979 to Gorman; 4,133,308 issued Jan. 9, 1979 to Lowe et al.; 4,280,491 issued Jan. 28, 1981 to Berg et al.; and 4,730,612 issued Mar. 15, 1988 to Dampney teach visored helmets containing rear mounted motorized fans in a duct forcing filtered air over the head and down to the user's face. The small diameter of the fans dictated by the duct size limits the air flow and requires high motor speed. The high motor speed causes noise problems and the limited air flow requires elaborate face sealing mechanisms on the visor to ensure that enough air flows past the nose and mouth that unfiltered air is not inhaled. U.S. Pat. No. 4,744,106 issued May 17, 1988 to Wang teaches a hard hat with a fan in a hinged fan element fitting into an aperture in the crown for blowing air over the head to cool it. A retractible curtain covers the open space in case of rain. The device does not provide filtered air for respiration, nor does it provide the complete head covering to prevent injury from small objects that would penetrate the air openings as does rain. Furthermore, the motor positioned above the fan blades yields a high center of gravity that is awkward for the active wearer.

SUMMARY OF THE INVENTION

It is accordingly an object of the invention to provide a helmet that protects the worker's head and face from trauma while supplying sufficient filtered air for cooling and respiration that it will not require special fitting and sealing of the visor to the face. It is yet another object to provide a helmet as described that is self-contained without an air hose and one whose air filters can be economically fabricated and easily changed.

The helmet of the invention includes a protective outer hard shell covering the head; a transparent visor covering the face; an aperture in the crown of the outer shell, a thin, flat low-voltage, electrically-powered motor and fan assembly arranged in a coplanar relationship with the blades surrounding the central motor, said assembly mounted in said aperture to maintain a low center of gravity; and a hard protective cover covering said aperture and connected to said helmet around said aperture with air spaces provided therebetween for passage of intake air to said fan. The air from the fan is directed down to the visor and over the face by lining cushions on the inner surface of the helmet. Filter means are provided in the air path to remove particulate or gaseous materials from the air. This type of fan assembly has a large diameter blade and provides much greater flow volumes to provide the necessary inhaled air without face seals for greater comfort and utility. The electric power to the fan may be provided by self-contained batteries or by remote, wire-connected battery such as at the waist or the battery on a motocycle for example. The large area air path permits a thin filter for reduced resistance to flow.

These and other objects, advantages and features of the invention will become more fully apparent when the following detailed description of preferred embodiments of the invention is read in conjunction with the accompanying drawings.

Detailed description of Preferred Embodiments of the Invention

Figure 1:
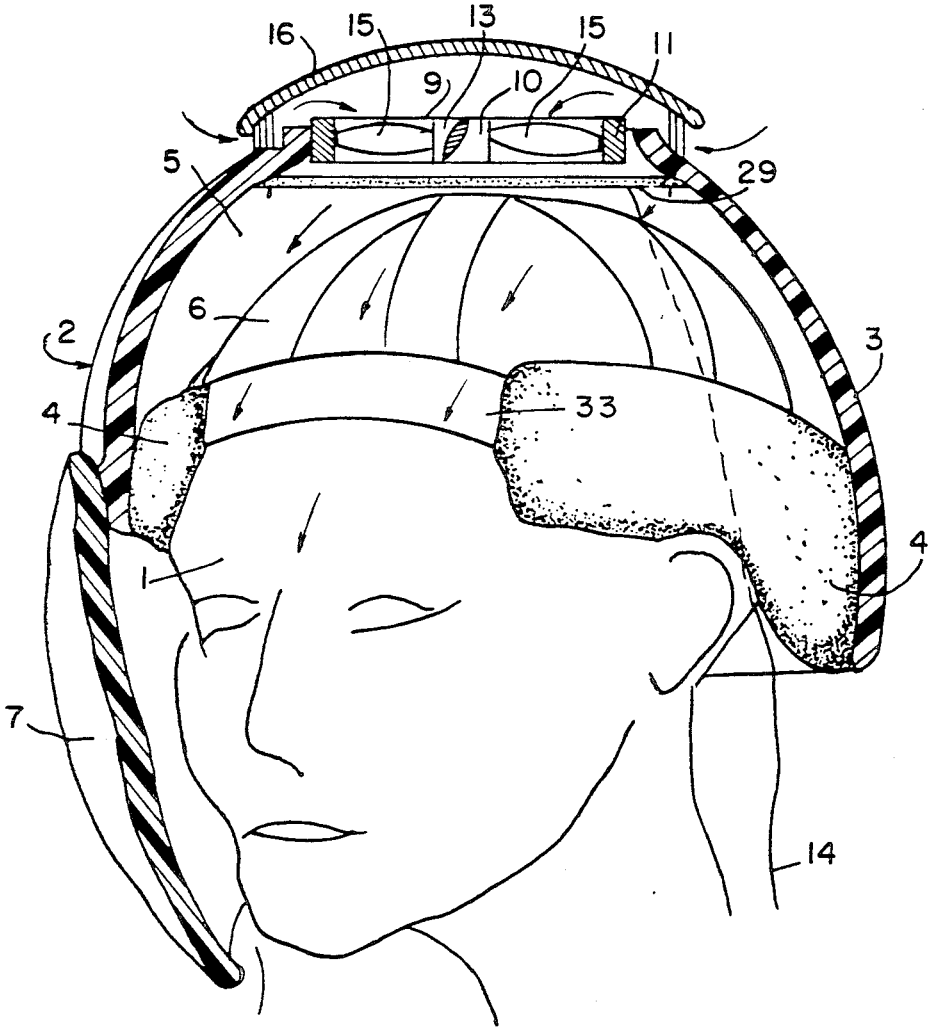
FIG. 1 is a diagrammatic front to rear cross sectional view of one form of the respirator helmet as worn.

FIG. 1 shows the head 1 protectively covered by the respirator helmet 2 comprising a hard outer shell 3 spaced apart from the head by resilient, shock absorbing cushions 4 to leave an air space 5. Optional adjustable harness 6 may also be provided to hold the helmet in position. A hard, transparent visor 7 is removably attached to the front of the hard shell 3 to protect the face and channel filtered air for respiration. A circular aperture 9 is formed in the crown of shell 3. Within the aperture a fan and motor assembly 10 is fixedly sealed to the shell by its outer casing 11 as may be seen more clearly in FIGS. 3 and 4. The assembly 10 comprises circular casing 11, and radial spokes 12 connecting the casing to centrally located electric motor 13. Electric cable 14 connects motor 13 to a battery power source, not shown, that may be detachably affixed to the helmet for short time use or to a waist mounted or otherwise located battery. The blades 15 are connected to the outer perimeter of motor 13 and extend radially therefrom in a coplanar relationship that provides a very thin, flat efficient fan motor assembly for blowing large volumes of air with high efficiency and having a low center of gravity when incorporated as shown. Fan-motor assemblies of this type may be only one inch thich, 3 to 4 inches in diameter and draw only 1 to 3 watts of power while blowing 30–80 C.F.M. of air, as exemplified by Panasonic Model FBK0912H.

Figure 2:
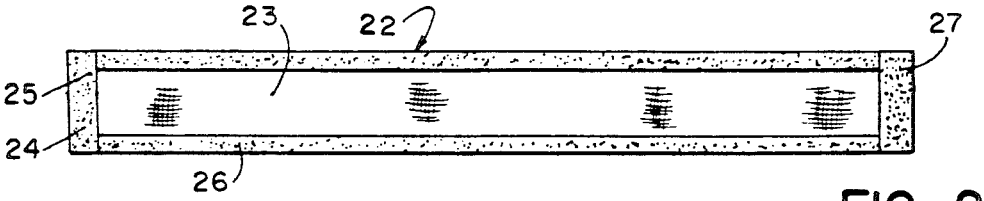
FIG. 2 is a plan view of the perimeter form of filter prior to installation.
Figure 3:
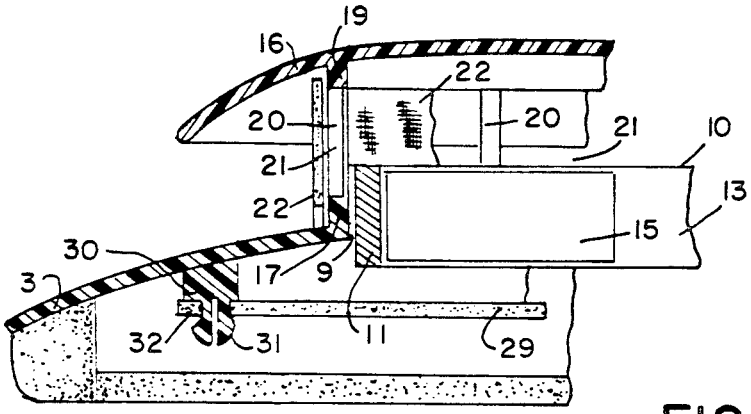
FIG. 3 is a cross sectional detail of the filter fan and cover attachments.

A hard dome shaped cover 16 extends over circular aperture 9 and attachments to maintain the protective integrity of the helmet. As best seen in FIG. 3, the circular aperture 9 in shell 3 is defined by an upturned rim 17. Cover 16 has a corresponding downturned ridge 19 of the same diameter. A plurality of spacer rods 20 fixedly connect the cover 16 to shell 3 while holding it spaced above rim 17 to provide intake air space 21 of considerable height extending in a circle of a diameter greater than the fan. Means are provided for mounting a cylindrical intake air filter 22 to cover this space 21 so that all intake air drawn in by the fan must pass therethrough. As shown in FIG. 2, this filter is economically formed from a strip of suitable filter material 23 held in a cardboard frame 24 to which adhesive has been applied. One end 25 is adhesively affixed to a spacer rod 20 and the strip is wrapped around with the long sides 26 affixed to the circular ridges 19 and 17 until the second short side 27 overlaps and sticks to end 25. This completely seals the intake aperture so that intake air must pass through it. This large area filter is most suitable for a particulate filter that may be rapidly clogged in a dusty environment because it is so easily changed and inexpensive. A thin particle filter of such a large area offers little resistance to air flow to ensure adequate filtered air supply.

Air leaving the fan can be filtered by a disc filter 29 that sealably mounts on circular ridge 30 that is sealed against shell 3. Alternatively, ridge 30 may be molded as part of shell 3. Split spring pins 31 and an adhesive on stiff rim (cardboard) 32 of disc filter 29 hold the filter sealed against the face of circular ridge 30 so that all air leaving fan 10 must pass therethrough. This filter may contain adsorbing or absorbing agents well known in the filtering art for removal of harmful gaseous materials and fumes from the respiratory air. It is readily accessible for replacement from inside the helmet. It also has a large surface area so that it may be made thin yet effective for reduced air flow resistance.

Figure 4:
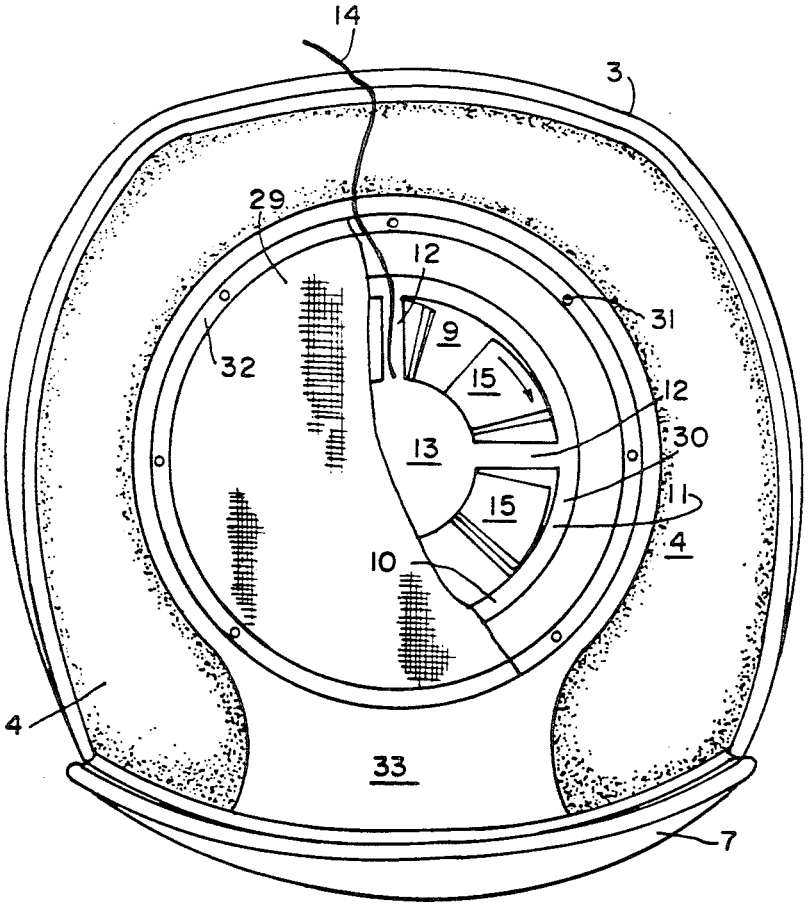
FIG. 4 is a bottom view of another form of the respirator/helmet with a portion of the filter broken away.

The resilient cushions 4, best shown in the bottom view of FIG. 4 of an embodiment without harness, hold the helmet in position, providing an air space between fan and scalp and an air seal about the head with an anterior aperture 33 through which the filtered air is directed over the forehead, beneath visor 7 to nose and mouth. The rate of air flow is great enough to provide all the air during inspiration so that no unfiltered air is sucked in through the sides or bottom of visor 7. Consequently, there is no need for fitted face seals or a neck curtain with valves as in the prior art. This results in a helmet that is much more comfortable to wear so that the worker is more likely to wear it and be protected. Furthermore, because it does not require special fitting, it is less costly to use.

The visor may include special filtering to screen out harmful rays such as in welder's goggles.

Certain of these flat fan-motor assemblies may have a rectangular outer frame. These may be cut away all or in part to fit the circular aperture or the aperture may be shaped to receive the frame.

The resilient cushions may optionally include sound shielding for the ears. Fan-motor assemblies of this type operate at low noise levels and the location of the resilient cushions 4 help screen out the fan noise.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

I claim:

1. A protective helmet providing filtered respiratory air comprising:

a) a hard headshell which in use extends over and serves to protect the forehead, top, rear and sides of the head of a user;

b) transparent visor means removably mounted on said headshell and providing protection for the eyes and face of said user;

c) aperture means in the upper portion of said headshell for receiving a fan and motor assembly;

d) a fan and motor assembly mounted in said aperture means, said fan and motor assembly including a central electric motor means, having two ends and a substantially cylindrical side wall, and a plurality of fan blades connected to said cylindrical side wall of said motor means and extending radially therefrom, said motor means and said blades arranged in a substantially coplanar relationship with minima thickness for reduced center of gravity;

e) a hard cover shell of a diameter greater than said aperture means covering said aperture means and connected by connecting means to the outer surface of said headshell around said aperture means, said connecting means providing a perimeter space between said cover shell and said headshell for the free passage of intake air to said fan blades;

f) resilient cushion means connected to the inner surface of said headshell for sealably engaging the sides and rear of said head to prevent the passage of air, said cushion means having a lower edge that does not extend below a horizontal plane through the ears of said user when said helmet is in operating position, said cushion means further providing a free air passageway beneath and at the outlet of said fan and motor assembly that extends forward in an opening in said cushion means to the forehead and beneath said visor means for respiration at the nose and mouth of said user; and g) filter connection means for sealably connecting filter means across the path of the air flow in at least one location for removing harmful materials from said air.

2. The helmet according to claim 1, in which said filter connection means includes a cylindrical element defined by said cover and said aperture means for filtration of intake air by a substantially cylindrical filter.

3. The helmet according to claim 1, in which said filter connection means includes a circular ring means on the underside of said headshell surrounding said aperture means for holding a substantially disc shaped filter.

4. The helmet according to claim 3, in which said filter connection means includes a cylindrical element defined by said cover and said aperture means for filtration of intake air by a substantially cylindrical filter.

5. The helmet according to claim 1, in which said visor means includes filtration means for filtering out harmful radiation.

6. The helmet according to claim 1, further including harness means inside said helmet for adjustably engaging the head of said user.

7. The helmet according to claim 1, in which said motor means is electrically connected to battery means removably attached to said helmet.

8. The helmet according to claim 1, in which said motor means includes electrical connection means for connection to an electrical power source unattached to said helmet.

* * * * *